United States Patent [19]

Plunk

[11] 3,942,833

[45] Mar. 9, 1976

[54] RUNNING TOOLS

[76] Inventor: Rowe A. Plunk, P.O. Box 1167, Midland, Tex. 79701

[22] Filed: Nov. 9, 1972

[21] Appl. No.: 304,993

Related U.S. Application Data

[63] Continuation of Ser. No. 859,140, Sept. 18, 1969, abandoned.

[52] U.S. Cl. ..... 294/86.18; 294/86.3; 294/86.32

[51] Int. Cl. ..... E21b 31/02

[58] Field of Search ..... 294/86.26, 83.6, 86.19, 294/86.2, 86.29, 86.32, 86.18, 86.21, 86.27, 86.28, 86.23

[56] References Cited

UNITED STATES PATENTS

| | | | |
|---|---|---|---|
| 1,285,523 | 11/1918 | Williams | 294/86.18 |
| 1,795,322 | 3/1931 | Tripleit | 294/86.15 |
| 2,614,881 | 10/1952 | Holland | 294/86.29 |
| 2,745,693 | 5/1956 | McGill | 294/86.18 |
| 2,889,170 | 6/1959 | Bode | 294/86.32 |
| 3,163,228 | 12/1964 | Hayes | 294/86.18 X |

*Primary Examiner*—Robert B. Reeves
*Assistant Examiner*—Charles A. Marmor
*Attorney, Agent, or Firm*—Strauch, Nolan, Neale, Nies & Kurz

[57] ABSTRACT

A running tool for setting and retrieving well devices in and from wells having a mandrel reciprocable in its axial bore and slips suspended from the mandrel for reciprocation therewith into and out of supporting engagement with a well device, the bore including a counterbore in its lower portion permitting expansion of the slips into releasing position and a reduced lower extremity for contracting said slips into supporting position. A spring, confined in the counterbore around the mandrel, constantly urges said mandrel and slips downwardly and permits relative downward movement of the tool and expansion of the slips upon setting of the well device. A latch assembly is adapted to maintain the mandrel and slips in their relative upper positions upon slow lifting of the tool and is releasable upon rapid raising of said tool due to the inertia of said mandrel and slips combining with the compression of the spring to overcome the force of the latch assembly and permit upward movement of said tool relative to said mandrel and slips and reengagement of the slips with the well device. A safety lock may be provided to hold the latch assembly inoperative and prevent the inertia of the mandrel and slips from becoming effective.

4 Claims, 11 Drawing Figures

RUNNING TOOLS

This is a continuation of application Ser. No. 859,140, filed Sept. 18, 1969, now abandoned.

SUMMARY OF THE INVENTION

A running tool for setting and retrieving well devices in and from wells including a housing having an axial bore in its upper portion, a counterbore in its lower portion and a bowl at its lower extremity. A mandrel is reciprocable in the bore and has slips suspended therefrom for reciprocation therewith into and out of engagement with a well device, the counterbore permitting expansion of the slips into releasing position and the bowl contracting said slips into supporting position. A helical spring is confined within the counterbore around the mandrel for constantly urging said mandrel and slips downwardly and permitting relative downward movement of the housing and expansion of the slips upon engagement of the well device with a stop. The upper end of the mandrel is reduced and tapered upwardly to provide a substantially conical head having a downwardly-facing shoulder and an underlying frusto-conical surface for coacting with a latch assembly carried by the housing, which includes a spring latch having an inwardly-offset portion for engaging beneath the shoulder upon relative downward movement of said housing to maintain said mandrel and slips in upper positions relative to said housing during slow lifting of the latter. Due to the inertia of the mandrel and slips as well as the compression of the spring, said mandrel and slips are prevented from moving from their lower to their upper positions upon rapid raising of the housing from its relative downward position when the tool is at rest. The latch assembly moves downwardly with the housing whereby the inwardly-offset portion of the spring latch slides out of engagement with the head of the mandrel onto its frusto-conical surface which flexes said spring latch outward sufficiently to permit its offset portion to ride upwardly over the shoulder onto said head upon subsequent sudden upward movement of said housing. Manifestly, slow lifting of the housing permits inward flexing of the spring latch and reengagement of its inwardly-offset portion with the shoulder of the mandrel before said offset portion can move said shoulder.

A safety lock may be provided for holding the latch assembly inoperative to prevent accidental release of the slips from the well device and includes pivoted means having a keeper for engagement beneath an extremity of the spring latch when the latter is flexed outward manually so as to withdraw its inwardly-offset portion from engagement with the mandrel. Due to the inoperativeness of the latch assembly, the mandrel and slips remain stationary upon relative reciproaction of the housing and the compression of the spring forces the slips into reengagement with the bowl and well device upon upward relative movement of said housing. The pivoted means includes an extension for upward engagement with an obstruction in the well upon upward movement of the tool whereby said means is rotated to disengage its keeper from beneath the extremity of the spring latch and permit the inwardly-offset portion of said latch to reengage the mandrel.

DESCRIPTION OF THE PREFERRED EMBODIMENT

Figure 2:
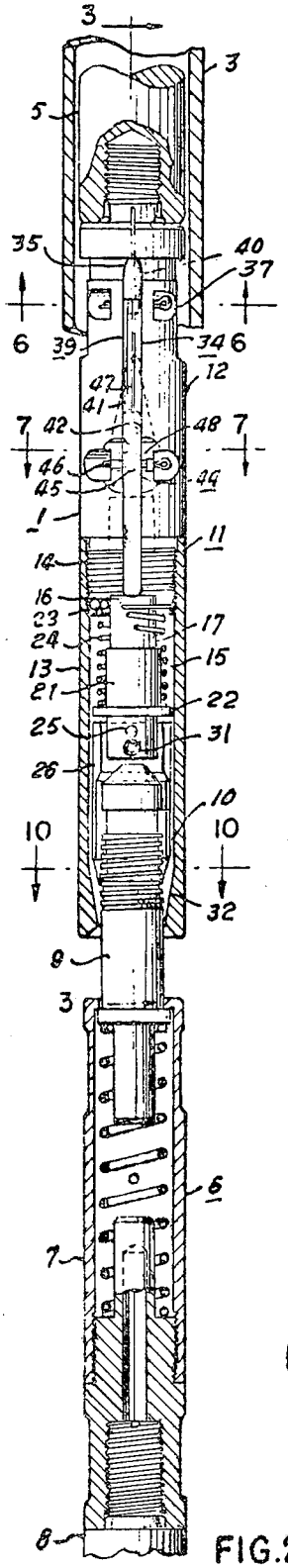
FIG. 2 is an enlarged, side elevational view, partly in section and taken at a right angle to FIG. 1, of the running tool, shock absorber and a portion of the bomb.
Figure 3:
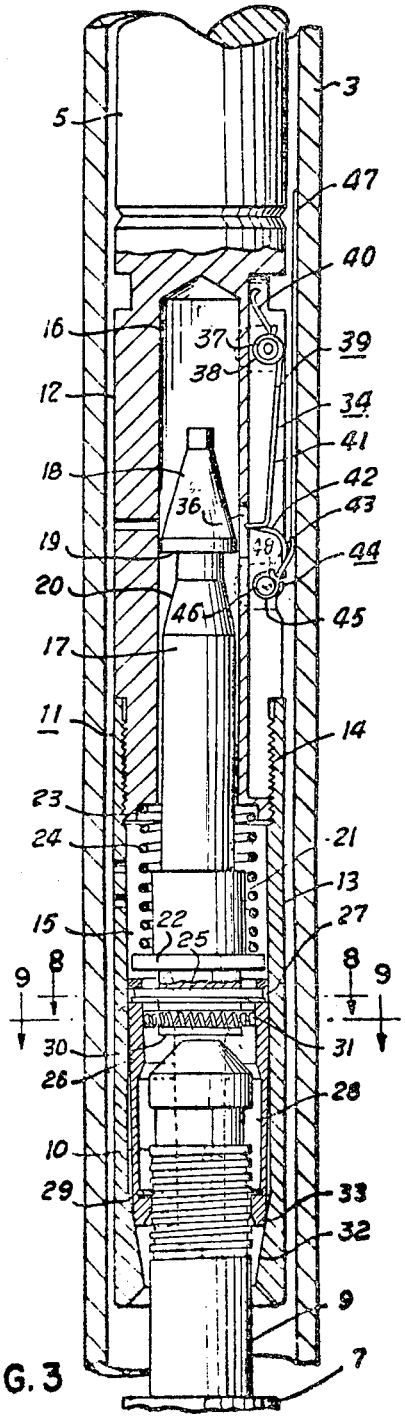
FIG. 3 is a full scale, transverse, vertical, sectional view, taken on the line 3—3 of FIG. 2, showing the locking of the latch assembly in retracted inoperative position more clearly.
Figure 5:
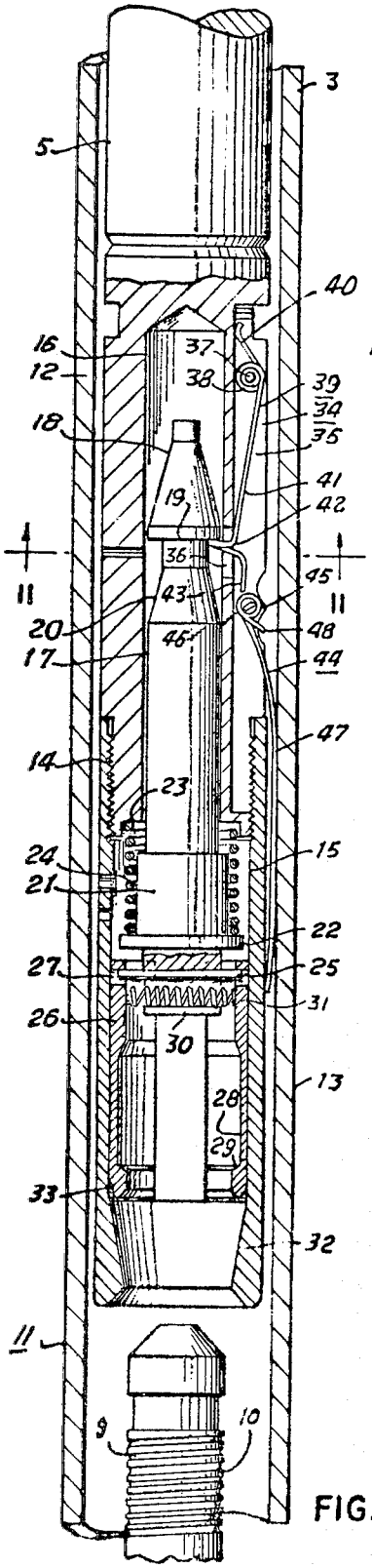
FIG. 5 is a view, similar to FIG. 3, showing the mandrel latched in its upper position for holding the slips of the tool in retracted position to release the fishing neck of the shock absorber.

In the drawings, the numeral 1 designates a running tool adapted to be suspended from a wire line 2 for movement through a well tubing 3 having a standing valve 4 at its lower portion. A weight bar, a portion of which is shown at 5, is interposed between the running tool 1 and wire line 2 and a well device 6 is adapted to be supported from said tool. Although subject to variation, the well device 6 is illustrated as including a shock absorber 7 and a pressure bomb 8 of conventional construction. A reduced fishing neck 9, having the usual annular grooves or threads 10, upstands from the shock absorber 7, or other well device, for releasable connection with the running tool (FIGS. 2, 3 and 5). It is noted that the well device may be of any suitable type capable of being lowered into and withdrawn from a well tubing on a wire line and having a fishing neck for detachable connection with the tool.

As best shown in FIGS. 3 and 5, the running tool 1 includes an elongate, cylindrical body or housing 11 having upper and lower sections 12 and 13 joined by a pin and box connection 14. The lower housing section 13 is in the form of a sleeve and has its cylindrical bore 15 communicating with the reduced, axial bore 16 of the upper housing section 12. A complementary, cylindrical mandrel 17, having a substantially conical head 18 at its upper end, is freely reciprocable in the bore 16 and depends into the bore 15 which functions as a counterbore for the housing 11. Below its head 18, the mandrel 17 is reduced in diameter and tapered upwardly to provide an annular, downwardly-facing shoulder 19 at the lower end of said head and an upwardly-facing frusto-conical surface 20 therebelow. As shown at 21, the lower end portion of the mandrel is enlarged in diameter and carries an annular, radial flange 22 intermediate its ends. An annular recess or counterbore 23 is formed at the lower extremity of the bore 16 of the section 12 to provide a downwardly-facing shoulder for coacting with the flange 22 to confine a helical spring 24 therebetween around the mandrel and within the bore 15 of the sleeve 13 whereby said mandrel is constantly urged downwardly. It is pointed out that the spring 24 is relatively weak so as to require little force to compress the same.

Figure 8:
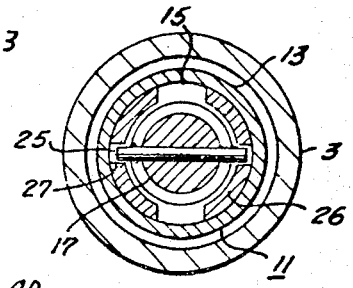
Figure 9:
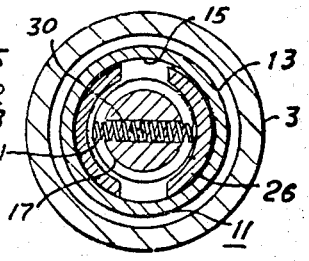
Figure 6:
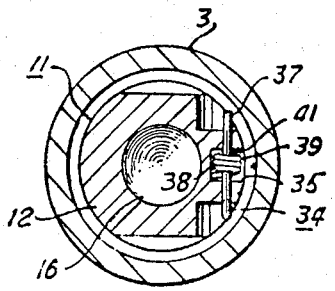
FIGS. 6, 7 and 10 are enlarged, horizontal cross-sectional views taken on the respective lines 6—6, 7—7 and 10—10 of FIG. 2, FIGS. 8 and 9 are horizontal, cross-sectional views taken on the respective lines 8—8 and 9—9 of FIG. 3.
Figure 10:
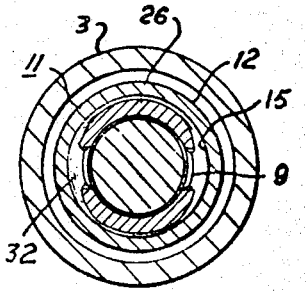

A horizontal pin 25 projects diametrically through the enlarged lower end portion 21 of the mandrel 17 immediately below the flange 22 (FIG. 8) for supporting a pair of opposed slips 26 by means of openings 27 at the upper ends of the latter. Each slip 26 is arcuate in cross-section and has its major intermediate portion 28 internally recessed to provide an upwardly-facing shoulder 29 at its lower end. A diametric, horizontal opening 30 extends through the mandrel portion 22 below and in vertical alinement with the pin 25 for receiving a helical spring 31 (FIG. 9) which has its ends bearing against the slips 26 so as to urge the same outwardly. It is noted that the bore 15 of the lower housing section or sleeve 13 is of sufficient diamter to accommodate hanging of the slips in expanded vertical position without permitting separation thereof from the pin. An upwardly-facing bevelled seat or bowl 32 is provided at the lower extremity of the bore 15 for engagement by exterior bevelled surfaces 33 on the lower ends of the slips 26 so as to contract said slips into supporting position. When the mandrel 17 is in its lower position relative to the housing 11 as shown in FIGS. 2 and 3, the spring 24 urges the slips downwardly to maintain the bevelled surfaces 33 engaged with the bowl 32 and the shoulders 29 engaged with the fishing neck 9. In the relative upper position of the mandrel, the spring 24 is compressed and the slips 26 are lifted out of engagement with the bowl so as to permit expansion of said slips and disengagement thereof from the fishing neck (FIG. 5) as will be apparent.

Figure 11:
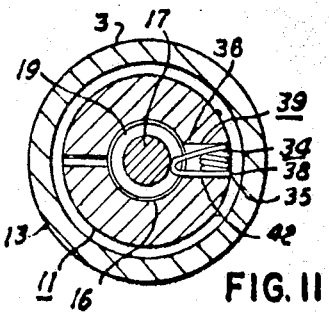
FIG. 11 is a horizontal cross-sectional view taken on the line 11—11 of FIG. 5.

A latch assembly 34 is provided for holding the mandrel 17 and slips in their upper positions relative to the housing and includes an elongate channel or groove 35 extending longitudinally of the exterior of the upper housing section 12 throughout the major portion of its length and communicating with the intermediate portion of its bore 16 through an elongate, vertical opening or slot 36. A horizontal pivot pin 37 extends transversely across the upper portion of the groove 35 for supporting thereon the helical coil 38 of a spring latch 39 in the form of a wire (FIGS. 2–6) which has a short leg 40 extending upwardly from one end of said coil and bearing against the bottom of said groove. An elongate leg 41 extends downwardly from the opposite end of the coil 38 and has an inwardly-offset portion 42 above its lower extremity 43 projecting through the slot 36 into the bore 16 for engagement with the shoulder 19 of the mandrel head 18 (FIGS. 5 and 11). It is noted that the spring latch 39 is of greater effective strength than the helical spring 24 so as to be capable of maintaining said spring compressed and holding the mandrel and slips in their raised or upper positions relative to the housing 11.

Figure 1:
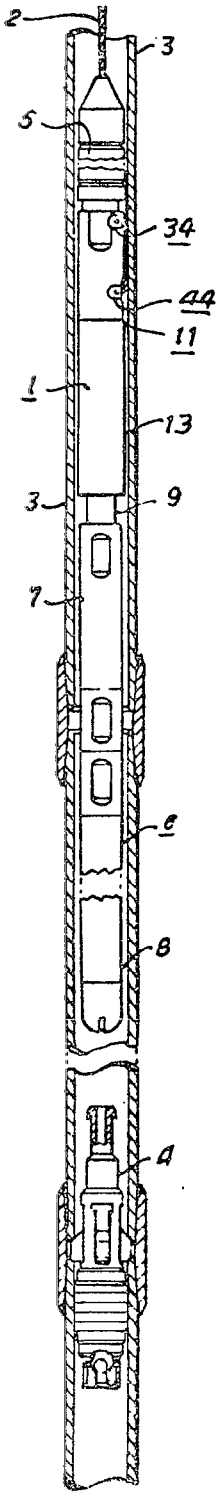
FIG. 1 is a broken side elevational view of a running tool, constructed in accordance with the invention, suspended within a well tubing on a wire line and supporting a shock absorber and pressure bomb above the standing valve of the tubing, with its latch assembly locked in retracted position.
Figure 7:
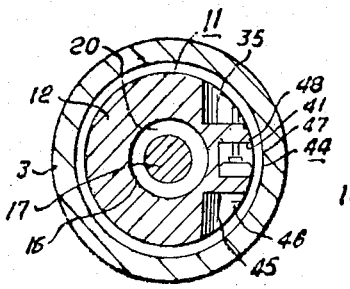

If desired, a safety lock 44 may be provided for maintaining the latch assembly 34 in its inoperative position with its spring latch 39 retracted outwardly and the offset portion 42 of the latch leg 41 withdrawn from the bore 16 of the upper housing section 12 (FIGS. 1–3). The safety lock 44 is in the form of a wire set as best shown in FIGS. 3, 5 and 7 and includes a helical coil 45 adjacent one end pivotally confined on a horizontal pin 46 extending transversely of the groove 35 below the lower extremity 43 of the latch leg. An elongate arm or finger 47 extends upwardly from one of the coil 45 which has a short, angular arm or keeper 48 projecting from its opposite end across the inner portion of the elongate arm or finger. When the finger 47 is swung upwardly, the keeper 48 moves therewith toward the lower extremity 43 of the latch leg 41 for underlying engagement with said extremity upon outward manual flexing of said leg whereby the offset portion of said leg is held in its outward position and prevented from engaging the mandrel 17. As a result, the mandrel 17 and slips 26 are urged downwardly by the force of the spring 24.

Even though the housing 11 may undergo limited downward movement relative to the mandrel and slips, the compression of the spring maintains said mandrel and slips in their lower positions upon upward relative movement of said housing and prevents separation of the tool from the fishing neck 9. During this relative movement, the slips expand when in the bore 15 but are contracted into supporting position upon engagement with the bowl 32. Manifestly, the safety lock 44 prevents accidental actuation of the running tool until said tool is moved upwardly so as to engage the lock finger 47 with one of the couplings of the tubing 3 and thereby force said finger outward and downward sufficiently to rotate said lock and disengage the keeper 48 from the extremity 43 of the latch arm 41 and permit reentry of the offset portion 42 of said arm into the bore 16 for engagement with the mandrel.

When a well device, such as the pressure bomb 8 and its shock absorber 7, are lowered into the well tubing, the mandrel 17 and slips 26 are in their relative lower positions with the bevelled exterior surfaces 33 of said slips engaged with the bowl 32 of the housing section 12 so as to clamp the internal shoulders 29 of said slips in engagement with the fishingneck 9 (FIGS. 1–3). The elements remain in this relationship due to the spring 24 until the safety lock 44 is actuated to release the spring latch 39 of the latch assembly 34 and the well device is engaged with the standing valve 4 or other stop in the tubing 3. Upon this engagement and due to the weight bar 5, the housing 11 of the running tool 1 continues to move downwardly relative to the stationary mandrel and slips so as to compress the spring and the inwardly-offset portion 42 of the latch arm 41 is positioned below the head 18 of said mandrel for engagement beneath the shoulder 19 upon subsequent lifting of said tool. It is pointed out that conventional jars (not shown) may be utilized instead of the weight bar to impart this relative downward movement to the housing. Under normal or slow upward movement of the housing 11 from its relative lower position, the force of the compressed spring 24 is insufficient to prevent inward flexing of the latch arm and engagement of its offset portion with the shoulder of the mandrel 17 (FIG. 5) and said mandrel and slips 26 are latched in their upper positions whereby the expanded slips release the fishing neck 9.

Figure 4:
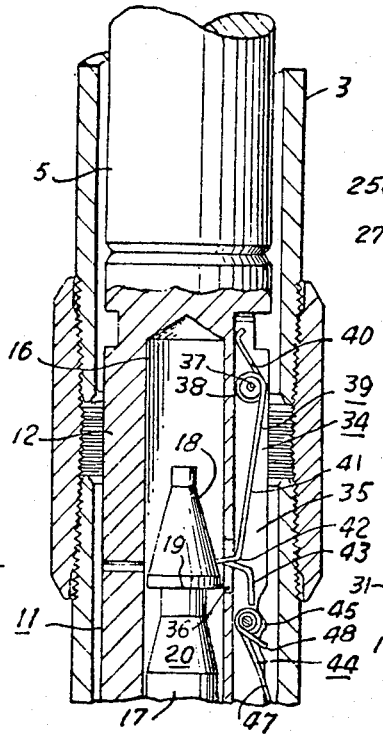
FIG. 4 is a view, similar to FIG. 3, of the upper portion of the tool with its latch assembly in operative position and disconnected from its lowered mandrel.

It is noted that the mandrel and slips remain in their relative lower positions upon sudden or rapid upward movement of the housing from its lower position. This is due to the fact that the inertia of the mandrel and slips, combined with the force of the compressed spring 24, is greater than the force of the spring latch 29. Upon relative downward movement of the housing 11, the offset portion 43 of the latch arm 41 slides downwardly over the head 18 of the mandrel 17, past the shoulder 19, onto the frusto-conical surface 20 which flexes said arm outwardly and the large bore 15 of the sleeve 13 permits the slips 26 to expand out of engagement with the fishing neck 9. If the subsequent upward movement of the housing relative to the mandrel and slips is rapid or sudden, the latch arm flexes inwardly but its strength is insufficient to maintain its offset portion positively engaged with the mandrel shoulder. Instead, the offset portion 42 is flexed downwardly and rides upwardly over the shoulder 19 into reengagement with the mandrel head (FIG. 4). At the same time, the compression of the spring holds the mandrel and slips downwardly so that the slips are engaged and contracted by the bowl into reengagement with the fishing neck before said mandrel and slips commence to move upwardly with the housing. Due to this arrangement, the running tool may be employed to retrieve well devices as well as set the same. Prior to retrieval, the mandrel and slips are in their upper positions (FIG. 5) to facilitate entry of the fishing neck of a well device between said slips. This relationship is not critical however, since the housing is adapted to undergo relative downward movement so as to permit spreading of the slips.

It is pointed out that abrupt or rapid relative reciprocation can be imparted to the housing by the actuation of conventional jars to create sufficient momentum which results in sudden upward movement of said housing relative to the mandrel and slips.

The foregoing description of the invention is explanatory thereof and various changes in the size, shape and materials, as well as in the details of the illustrated construction, may be made without departing from the spirit of the invention.

What is claimed is:

1. A running tool for setting and retrieving a well device comprising a tubular housing having a tapered portion at the lower end of its bore adapted to receive the upper end of said device, a mandrel reciprocable in said housing from a lower position to and above an upper position, slip means carried by said mandrel, said slip means being disposed in engagement with said tapered portion in gripping position when said mandrel is in its lower position and out of engagement with said tapered portion in release position when said mandrel is at or above said upper position, said mandrel being disposed above said upper position when tool is lowered fully, first spring means urging said mandrel toward said lower position, and latch means carried by said housing for selectively holding said mandrel in said upper position, said latch means comprising a latch portion moveable into and out of engagement with a downwardly facing shoulder on said mandrel, said latch portion being spaced below said shoulder when said mandrel is above said upper position, second spring means biasing said latch portion toward engagement with said shoulder, said second spring means having a predetermined strength sufficient to retain said latch portion in latching engagement with said shoulder upon slow upward movement of said housing whereby said housing, said mandrel, and said slip means may be moved upwardly together with said slip means latched in its upper release position, but said predetermined strength being insufficient to retain said latch portion in latching engagement with said shoulder upon rapid upward movement of said housing, whereby during said rapid upward movement, said latch portion rides outwardly over said shoulder due to the inertia of said mandrel, and said slip means is moved by said first spring means to its lower gripping position with said device.

2. The running tool according to claim 1 wherein the interior of said tubular housing is enlarged to provide a counterbore having a downwardly facing shoulder at its upper end, the lower portion of said mandrel extending into the counterbore and having a radial flange thereon and said first spring means being confined on said mandrel between the shoulder and the flange.

3. The running tool according to claim 1 wherein said latch means comprises an arm extending axially of said housing and pivotally received in a channel in said housing, and said latch portion comprises an inwardly offset portion of said arm extending through an opening in said housing for selective engagement with said mandrel.

4. The running tool according to claim 3 wherein said second spring means is formed integrally with said arm.

* * * * *